US006042183A

United States Patent [19]

Carnahan et al.

[11] Patent Number: 6,042,183

[45] Date of Patent: Mar. 28, 2000

[54] CHAIR WITH STRONG MAGNETIC FORCE STAND

[76] Inventors: Garnett Hugh Carnahan; Ben Tsou Carnahan, both of 337 E. Lindbergh Rd., Nixa, Mo. 65714

[21] Appl. No.: 09/148,626

[22] Filed: Sep. 4, 1998

[30] Foreign Application Priority Data

Sep. 19, 1997 [CN] China ..... 97 2 41731

[51] Int. Cl.[7] ..... A47C 3/00

[52] U.S. Cl. ..... 297/310; 297/463.2

[58] Field of Search ..... 297/344.12, 217.1, 297/463.1, 463.2, 451.5, 451.4, 310, 270.1, 270.3, 270.5; 248/309.4, 501, 502, 188.9, 188.91, 467, 188.8; 29/428

[56] References Cited

U.S. PATENT DOCUMENTS

| | | |
|---|---|---|
| 1,073,860 | 9/1913 | Leland . |
| 2,458,621 | 1/1949 | Miller . |
| 2,519,466 | 8/1950 | Hauser . |
| 3,186,673 | 6/1965 | Olson . |

OTHER PUBLICATIONS

Internet printout (2–pages), Magnetic Mounts for Antennas, Firestik ® *Antenna Company*, Phoenix, Arizona, USA. "Products & Services Section", Magnetic Assemblies 1995, *Thomas Publishing Company* (4–pages).

The Springfield Marine Company 1996 (2–pages), "Helmsman & Companion Chairs".

*Primary Examiner*—Milton Nelson, Jr.

*Attorney, Agent, or Firm*—Smith, Gambrell & Russell, LLP

[57] ABSTRACT

A chair with a strong, but detachable at will, magnetic force stand which preferably includes a swivel chair seat, a vertical spindle, a spindle seat, support legs and a plurality of permanent magnet assemblies provided at the free ends of legs extending out from a thickened hub section supporting the spindle seat. The legs are preferably in an equiangular arrangement with respect to the spindle seat, and the permanent magnet assembly is mounted at a fee end of each of the preferably 3–6 legs. The permanent magnet assemblies include a housing to which a permanent magnet is releasably set and can also be provided with a magnet release device, although for many chair arrangements a release facilitator is not required for achieving detachment, and yet the magnets have sufficient holding strength. When a swivel chair is fixed, the attraction to the underlying support such as the steel deck of a ship, provides sufficient holding power to avoid inadvertent release. When the chair is to be moved away, an operator applies a moving force to the upper extremity of the chair (i.e., the chair seat) which due to the configuration of the chair provides for release.

8 Claims, 3 Drawing Sheets

CHAIR WITH STRONG MAGNETIC FORCE STAND

FIELD OF THE INVENTION

The present invention relates to a chair with a strong magnetic force stand, and, in a preferred embodiment, a chair which is a combination of a support base with magnetic fastening members and a swivel seat assembly.

BACKGROUND OF THE INVENTION

Due to the rocking motion of floating vessels such as ships, any apparatus placed on a ship must be firmly fixed to avoid damaging the apparatus, the ship, or some other component supported by the ship. Typically, fastening involves either bolting or welding components directly to the structure of the ship or bolting or welding mounting members to the ship and then attaching the apparatus to the mounting members. The same requirement applies to chairs which, particularly with respect to pleasure boats and passenger or ferry boats, occupy a great deal of space often both on the exposed deck and down under within the internal area of a ship. All types of boats or ships include various forms of chairs, whether they are used merely for the purpose of providing a passenger with a place to sit or for providing an operator of the ship a seating location with respect to instruments or other equipment.

The prior art chairs used in this environment are usually permanently fixed to the ship such as by welding the support portion of the chair to the ship body or by bolting the chairs to the ship deck such that they are not readily removable (with respect to the latter, particularly after a period of time when the harsh environment associated with ships renders the fastening area rusted or corroded). Thus, with respect to the prior art chairs that are welded, bolted or otherwise not readily releasable from position, once these chairs are in position, they permanently occupy that space of the ship. This significantly reduces the effective space of a ship, which space is often originally restricted in size, as the deck or other area of the ship becomes more narrow and smaller due to the placement of one or more fixed chairs. This limited space often gives an uncomfortable feeling to those who live and work in the crowded space of a ship over the years. Furthermore, the fixed chairs can only be used at specific positions which may not be a convenient location with respect to ongoing activity on board the ship, and their installation damages the original state of the ship.

The fact that a chair must be provided for each place where a chair might be necessary (e.g., providing for maximum seating during a particular season or period of time where, in other seasons or periods of time, there might be many more seats than required) increases the number of chairs needed and the weight load on a ship and, correspondingly, the fuel requirements for a ship. In an effort to avoid the above drawbacks, instead of fixed chairs, ordinary movable chairs have been used. However, both from a passenger safety and chair or ship damage standpoint, it is not desirable to have non-secured chairs of this sort.

SUMMARY OF THE INVENTION

The purpose of the present invention is to provide a chair, preferably of the swiveling type, which is readily attachable and detachable to a ship and yet provides a stationary platform for the seat of the ship. In a preferred embodiment, this attachment is provided by way of a strong magnetic force chair support stand. The chair of the present invention can thus improve the environmental conditions of workers and passengers on a ship by allowing for a more efficient matching of the number of seats and the location of seats with respect to present day situations. Thus, for a passenger boat or the like an average number of seats can be placed on board and, just prior to departure, the actual number of seats can be increased or decreased with the assistance of a local chair supply provided in an off-ship area, with the increase or decrease based on actual or low error predictions as to ticket sales or on an actual passenger count. Also, for those vessels having suitable metallic decking to which the permanent magnets attach, there is avoided having to damage that surface with the addition of bolt holes or fastener material protrusions.

The present invention features a support assembly on which a seat rests with the seat preferably being a swivel seat supported by a swivel post or spindle received in a spindle reception member with chamber that is supported by a base assembly. The base assembly is preferably comprised of at least three support legs which are circumferentially spaced (preferably equally) and extend out radially from a central hub which has a central, vertical cavity from which the spindle reception member extends or within which is directly formed a spindle reception cavity. At the outer, free end of each support leg there is provided a permanent magnet support housing.

Within each of the magnet reception housings there is provided a permanent magnet. The combination of permanent magnets on the legs is arranged (from the standpoint of size and material and magnetic attraction strength) to provide a stable platform that is attachable to a metallic ship deck (e.g., a steel deck) or a non-metallic ship deck with added, permanent magnet attaching metal plating in areas which are potentially desirable for seat location. The attachment of the permanent magnets ensures that detachment does not occur during a typical range of usage and more preferably that range plus an added factor of safety (e.g., an additional 1.5 to 2.0 factor of safety value over the high end of typical usage loading).

When it is desired to detach a seat from the metallic deck support, a person applies a force directed at the upper extremity of the chair seat until at least one of the individual magnets becomes detached whereupon any remaining magnets will become detached upon further manipulation of the seat. For example, with a seat height of 3 to 5 ft., a person with average strength can push on the top end of the seat and release the attachment, and yet the attachment is sufficient to maintain the seat secured within the desired usage parameters discussed above. That is, the seat will not become detached during at least normal seating operation until it is desired to detach the seat and, when it is desired to detach the seat, it can easily be carried out by a single operator. Thus, while the present invention can include, for example, less than three seat leg/permanent magnet combinations (e.g., a single, centralized large permanent magnet), the three or more seat leg/permanent magnet combinations provides a good degree of stability and also a proper relationship between the strength of attachment and the ability to release the magnets when desired.

While it has not been found necessary under the present arrangement of the present invention, the individual housings for the permanent magnets can further include release assemblies such as a lever cam arrangement, which can operate in similar fashion to conventional metallic sheet hand graspers which have a lever that, when rotated, pushes a cam surface or the like against the sheet to facilitate detachment of the magnet. Under the illustrated arrangement of the present invention, this may include an added telescoping outer housing or lever arrangement which upon manipulation of an appropriate lever (a foot operated integral foot lever) is lowered with respect to the fixed magnet and the internal housing surrounding the magnet until contact with the deck is made whereupon further downward movement of the outer housing causes detachment. This arrangement may be desirable when additional attachment strength is desired to the extent that the combined strength of the magnets makes release by applying a force against the chair seat difficult or in situations where the height of the seat is very low (e.g., below 2 ft. as in a bench like seat with low backing rail).

One technique for fixing the permanent magnet in position with respect to its cup-shaped housing, is the use of a relatively large set screw which is threaded through the housing until the permanent magnet is sufficiently compressed against the interior of the housing so as to lock it in place. A variety of alternative techniques can also be relied upon such as a molded reception area in the housing with lower holding flange or the like. Also, a non-scratch, non-magnetic field interfering material bottom cap (formed of a softer material than the typically compressed and hardened metallic powder used for permanent magnets) can be utilized. If a set screw arrangement is utilized, it is preferable for the set screw head to be positioned on the side or portion of the housing that is radially the closest to the hub. The same would hold true for any additional release mechanism as such a positioning helps avoid inadvertent contact and provides a better visual appearance.

Also, to help avoid detachment of the permanent magnet housings from the seat legs, particularly during forced permanent magnet detachment, the cup-shaped housings are provided with threaded or otherwise non-axially releasable fasteners with or without rotation capability. These fasteners can extend vertically up from within and/or through the housing and into suitable reception holes provided by a reception housing cylinder formed at the free end of each seat leg. The vertically extending members can be formed either integrally or as separate components with respect to the magnet housing, and the permanent magnet can be in disk form with its thickness less than the total height of the housing to provide head space for an inserted vertically extending pin or bolt-like member passing through the top of the housing.

BRIEF DESCRIPTION OF THE DRAWINGS

The detailed structure of the present invention is given by way of a non-limiting example in the following embodiment and accompanying drawings wherein:

FIGS. 1–3 illustrate a preferred embodiment of the present invention which feature a swivel chair with strong magnetic force stand combination. This combination comprises a chair seat 1, preferably three or more (and more preferably five as shown) support legs 4, with each leg having at least one permanent magnet assembly 5. Beneath the chair seat 1 there is vertical spindle 2, which is fitted into the central hole of the spindle seat 3. The vertical spindle 2 can be rotated in the central hole. Thereby, a swiveling mechanism is formed for the rotation of chair seat 1. If desired, the height of the swiveling chair seat can be made adjustable so that not only can the chair rotate, but also the height of the chair seat can be adjusted. On the lower portion of the spindle seat, a hub portion 31 with a relatively large size is provided. The relatively larger size of the hub takes into consideration the fact that during the detachment process much of the release force will be focused on this area of the chair since both the legs and spindle assembly intersect at this location. This larger hub area typically has an outer diameter of at least 1.5 times, and more preferably, at least two times the outer diameter of the inserted spindle (e.g., a ratio of 0.8:1.0:2.0, with respect to the external diameters of the inserted spindle, spindle seat and hub). As shown in the drawings, on the hub portion 31 of the spindle seat 3, there are several support legs 4 which are radially extending and equiangular disposed for supporting the swivel chair. The number of the support legs 4 may be three or more. At the free end 41 of each outwardly extending support leg 4, there is located a cylindrical body 42 in the center of which a bolt hole 43 is defined. The cylindrical body 42 and the support leg 4 are preferably made as a monolithic unit, although body 42 can also represent a separate element fastened to the outer end of a leg.

Figure 1:
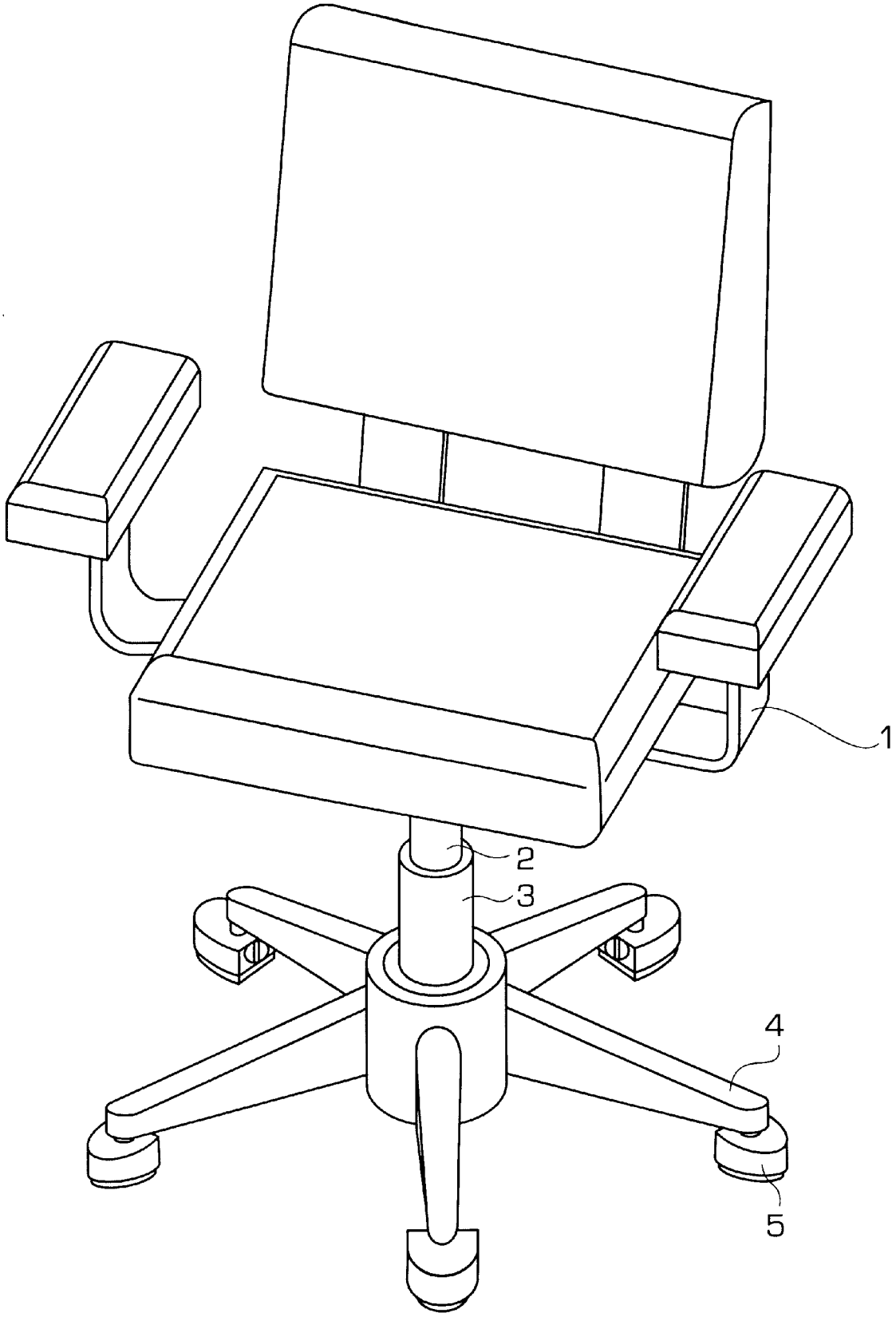
FIG. 1 is an axiomatic drawing of a swivel chair with a strong magnetic force stand.
Figure 2:
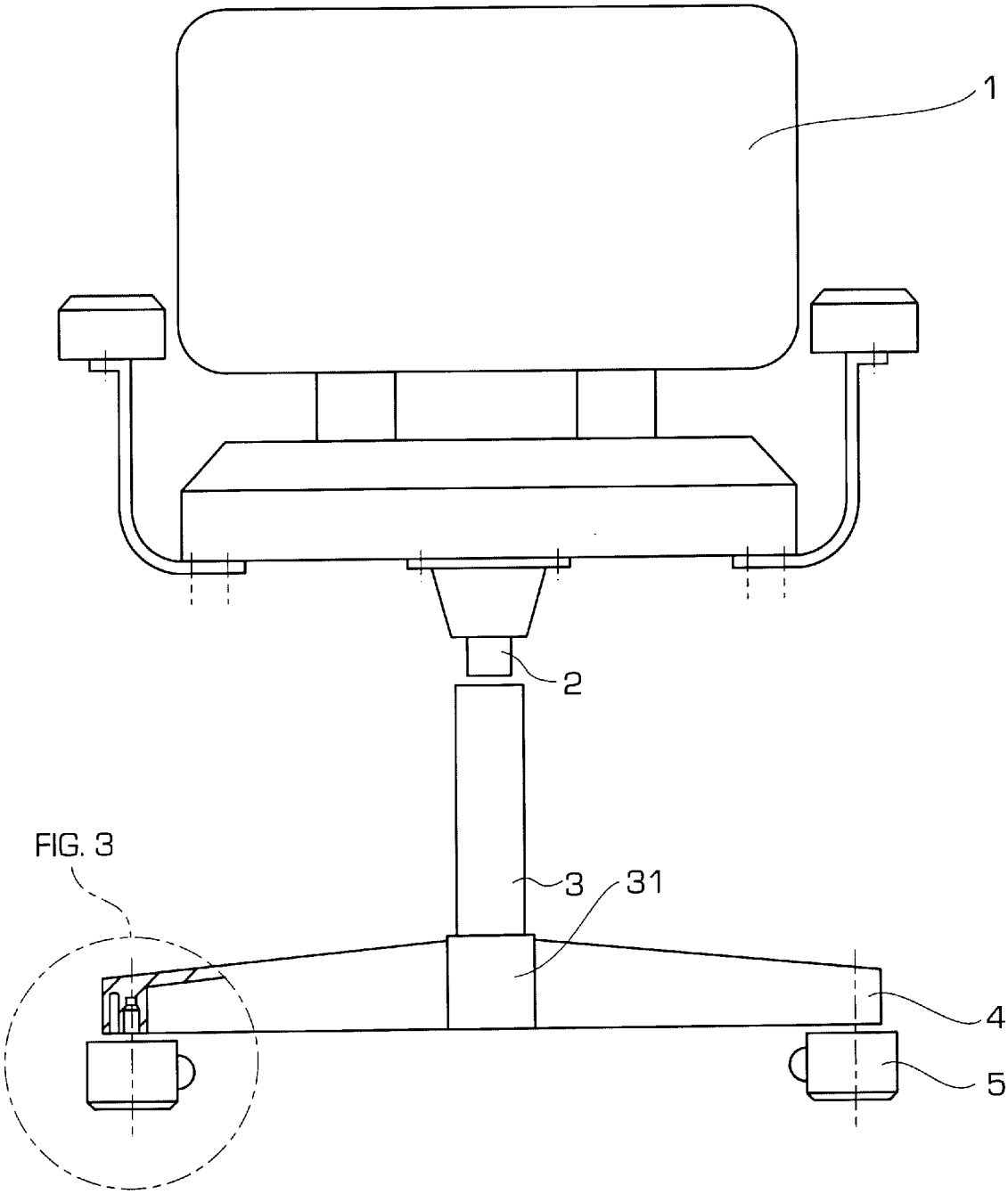
FIG. 2 is a schematic view showing the combined structure of FIG. 1.

The permanent magnet assembly 5 features permanent magnet 54 which can be a conventional permanent magnet such as those used in other devices like the above described hand grasper or in acoustic speakers. In a preferred embodiment, the permanent magnet 5 is in the form of a ¾" thick solid disk having a 1.5" diameter (a type typically used for acoustic speakers). This solid disk is fixed in place by set screw 53 which extends through a thickened section of the housing 531 and into contact with magnet 54 so as to compress it against the interior of housing 531. The set screws head 532 is positioned on the radial most inward surface of the housing or closest to the hub as possible so that it is less likely to come in contact with a person and is also more hidden from view.

Figure 3:
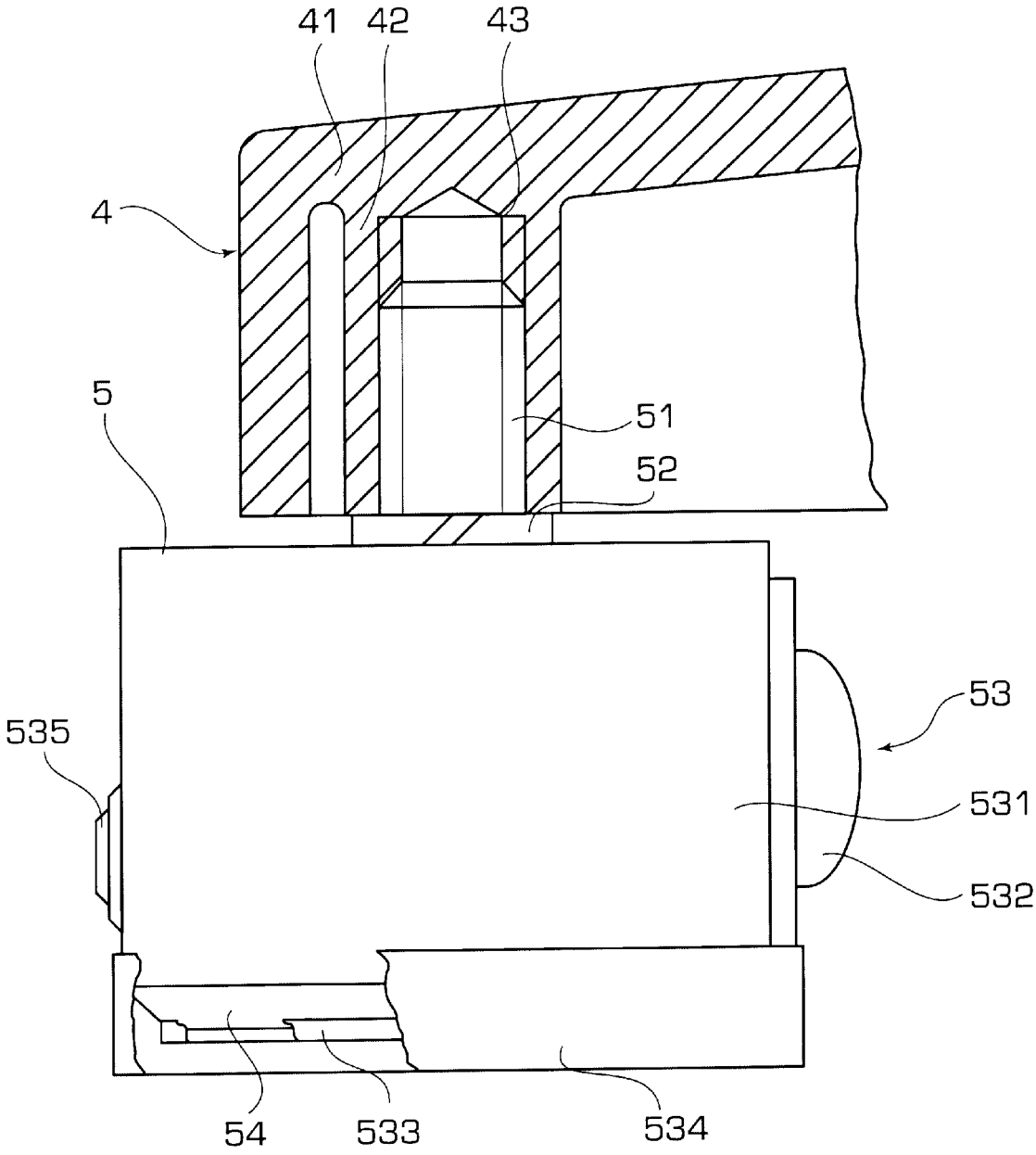
FIG. 3 is a partially enlarged view of portion "A" of FIG. 2.

Housing 531 is sized such that a portion of magnet 54 extends out away from the housing as shown in FIG. 3. A suitable coating or laminate, such as that represented by reference number 533 in the FIG. 3 cut-away view, that does not appreciably interfere with the magnetic attraction force of the magnet and which provides a non-scratch function can be added directly to the bottom of the magnet or supported by the housing such as in a cap-like arrangement. The periphery of the magnetic lock 54 can be in other forms such as, for example, a square or other polygonal. Vertically extending member 51 is in the form of a pin or other caster-like embodiment such as a double-screw bolt 51. Member 51 can be formed as an integral portion of the housing or can be a separate member inserted through a central hole in the upper surface of the housing before the magnet is set in place. Hence, the permanent magnet assembly 5 is fixed onto the free end portion 41 of the support leg 4 by screwing the double-screw bolt 51 into the bolt hole 43 or otherwise engaging the member 51 within hole 43 in caster-like fashion. A rotational caster arrangement can be provided, although the fact that the permanent magnets fix the seat in position would make rotation superfluous for most situations (although a rotation arrangement could facilitate movement of the chair from or into the locking position).

Spring washer 52 is interposed between the housing and the cylindrical body representing free end portion 41 in the illustrated embodiment to prevent loosening of the double-screw bolt. The bottom planes of each magnet body 54 of the support leg 4 should be placed on a common plane on the assumption that the receiving surface will be level. However, adjustments in the degree to which the magnets extend out from the body to compensate for uneven support surfaces can be easily made by way of manipulation of the releasable set screw to provide for adjustment of the magnet with respect to the housing. Added height adjustment facilitating means such as a plurality of level indicia indications on the magnet itself can also be provided (not shown). The indicia can include, for example, a plurality of circular rings applied to the side surface of a permanent magnet at a certain distance apart (e.g., ⅛" spacing).

In use, the swiveling chair is moved to the desired location on the vessel, and the bottom plane of each magnetic body 54 is stuck smoothly to the deck of the boat. In another embodiment of the present invention, thick end caps, such as that represented by reference number 534 in the FIG. 3, cut away view, can be provided over the end of each housing 531 so as to prevent inadvertent attachment during times the chairs are being dragged across a steel deck (would be dependent to some extent on the weight of the chairs involved and whether they can be easily lifted). As the permanent magnets typically have a relatively close-in strong attraction range, the thickness of, for example, a plastic cap that has an upper flange encircling the housing 531, would be based on the known attraction field of the magnet. The caps can also be attached to the housing 531 with ties or the like or entirely removable. Once in the proper location, the magnets generate a strong magnetic force so that they are fixed to the ferromagnetic deck, thereby the function for stable fixation of the swiveling chair on the deck is achieved.

As previously described, when the chair is needed to be moved away to another site, a person need only apply a force against the upper extremity of the chair seat until the magnets all become detached, at which point the chair can be moved to a storage location either on the vessel or off the vessel.

In addition, release facilitation means such as that represented by reference number 535 in the FIG. 3 cut-away view can be provided on one or more of the permanent magnet assemblies 5. For example, the housings 531 can be provided with two parallel side surfaces which support in pivoting fashion a dual, interconnected lever assembly having curved bottom contact cam ends which act to lift the housing up when a foot or the like presses down on the upper extremity of the interconnected lever assembly above the pivot location. The interconnected lever assembly preferably has a ladder shape with one or more transverse strength increasing rods extending between a pair of sled runner-shaped levers with curved cam ends. The levers can be straight or angled with the angle arrangement allowing for extension below the legs and a good initial foot contact surface. Alternatively, the permanent magnets can be mounted within an encompassing housing and the set screw head 53 can instead represent a tool reception end of an angle rod that moves to between the supported magnet and the housing and has a main body movable between a non-floor contact position and a floor contact/release position.

The above described components such as the magnetic housing, hub, legs, spindle seat, spindle and chair seat can be made of a variety of material having sufficient strength such as metal or reinforced plastics. The present invention can be used in any situation where a stable and non-movable chair seat platform is desirable, together with the additional feature of being able to easily detach and attach the chair at will. Thus, the present invention is particularly well suited for use on any type of naval vessel, although other uses might also be desirable, particularly when consideration is given to the ability of the seats to retain a desired position unless a concerted effort is made to move them and the ability for suitable floor plates to be put down. Thus, the chairs of the present invention can be used in various settings where there is either a preexisting or added ferromagnetic floor and in various applications where the chairs need to be fixed. In addition, the present invention not only can be used with the swivel chair described, but is also well suited for other chair types.

Although the present invention has been described with reference to preferred embodiments, the invention is not limited to the details thereof. Various substitutions and modifications will occur to those of ordinary skill in the art, and all such substitutions and modifications are intended to fall within the spirit and scope of the invention as defined in the appended claims.

What is claimed is:

1. A chair, comprising:

a chair seat;

an intermediate seat support supporting said chair seat;

a support base which is connected to said intermediate seat support and includes a plurality of permanent magnet assemblies positioned radially out from said intermediate seat support.

2. A chair as recited in claim 1 wherein said support base includes a plurality of legs, and the permanent magnet assemblies are attached to an outer end region of said legs.

3. A chair as recited in claim 2 wherein said intermediate seat support includes, a vertical spindle, a spindle seat and a hub which is connected to internal ends of said legs, and wherein there are at least three support legs.

4. A chair as recited in claim 2, wherein said legs are radially extending legs.

5. A chair as recited in claim 1 wherein at least one of said permanent magnet assemblies includes a release facilitator mechanism.

6. A chair as recited in claim 1 wherein each of said permanent magnet assemblies comprises a removable plastic cap dimensioned to avoid inadvertent magnetic attraction during chair positioning.

7. A chair as recited in claim 1 wherein each of said permanent magnet assemblies comprises a permanent magnet and a non-scratch laminate on a bottom portion of said permanent magnet.

8. A method for assembling a chair comprising:

providing a chair seat and intermediate chair seat support designed to supportingly receive the chair seat;

providing a chair seat base designed for attachment with said intermediate chair seat support; and providing a plurality of permanent magnet assemblies which are dimensioned for location at an extremity of said seat base.

* * * * *